US011767690B2

(12) United States Patent
Bendel et al.

(10) Patent No.: US 11,767,690 B2
(45) Date of Patent: Sep. 26, 2023

(54) DOOR HANDLE MODULE

(71) Applicant: Kiekert AG, Heiligenhaus (DE)

(72) Inventors: Thorsten Bendel, Oberhausen (DE); Marco Eggert, Düsseldorf (DE)

(73) Assignee: Kiekert AG, Heiligenhaus (DE)

( * ) Notice: Subject to any disclaimer, the term of this patent is extended or adjusted under 35 U.S.C. 154(b) by 33 days.

(21) Appl. No.: 16/982,622

(22) PCT Filed: Mar. 18, 2019

(86) PCT No.: PCT/DE2019/100242
§ 371 (c)(1),
(2) Date: Sep. 21, 2020

(87) PCT Pub. No.: WO2019/179564
PCT Pub. Date: Sep. 26, 2019

(65) Prior Publication Data

US 2021/0025203 A1 Jan. 28, 2021

(30) Foreign Application Priority Data

Mar. 21, 2018 (DE) ..... 10 2018 106 657.0

(51) Int. Cl.
*E05B 81/76* (2014.01)
*E05B 81/80* (2014.01)
(Continued)

(52) U.S. Cl.
CPC ..... *E05B 81/77* (2013.01); *E05B 79/20* (2013.01); *E05B 81/78* (2013.01); *E05B 81/80* (2013.01);
(Continued)

(58) Field of Classification Search
CPC ..... E05B 81/76; E05B 81/77; E05B 81/78; E05B 81/80; E05B 81/90; E05B 79/06;
(Continued)

(56) References Cited

U.S. PATENT DOCUMENTS 5,560,659 A * 10/1996 Dault ..... E05B 85/18 292/336.3
7,062,945 B2 * 6/2006 Saitoh ..... E05B 81/78 49/460
(Continued)

FOREIGN PATENT DOCUMENTS

CN 1609389 A 4/2005
DE 2023859 A1 11/1971
(Continued)

OTHER PUBLICATIONS

Computer Generated Translation for DE 10114214 A1, Generated on Jan. 13, 2022, https://worldwide.espacenet.com/ (Year: 2022).*
(Continued)

*Primary Examiner* — Alyson M Merlino
(74) *Attorney, Agent, or Firm* — Renner, Otto, Boisselle & Sklar, LLP

(57) ABSTRACT

A door handle module for a movable part of a vehicle, in particular for a side door, tailgate, bonnet or luggage compartment hatch, comprising a handle support that can be mounted on the outer skin of the movable part, a handle mounted movably on the handle support and having an operating mechanism that can be hidden at least in part by the outer skin, the operating mechanism being operatively connectable to a latch or a latch drive so that an, in particular mechanical, operation of the latch of the movable part can be performed, and further comprising a sensor unit having at least one sensor element in order to detect a user intention in an operating region of a door handle depression of the movable part so that the lock or the latch drive is electrically actuatable in the operating region in the event that a user intention is identified.

17 Claims, 3 Drawing Sheets

(51) Int. Cl.

| | |
|---|---|
| ***E05B 85/06*** | (2014.01) |
| ***E05B 85/18*** | (2014.01) |
| ***E05B 79/20*** | (2014.01) |
| ***E05B 81/78*** | (2014.01) |
| *E05B 17/10* | (2006.01) |
| *E05B 77/04* | (2014.01) |

(52) U.S. Cl.
CPC ..... *E05B 85/06* (2013.01); *E05B 85/18* (2013.01); *E05B 17/10* (2013.01); *E05B 77/04* (2013.01)

(58) Field of Classification Search
CPC ..... E05B 79/20; E05B 79/22; E05B 85/10; E05B 85/14; E05B 85/16; E05B 85/18; E05B 77/02; E05B 77/04; E05B 77/06; E05B 77/12; Y10T 292/57; Y10S 292/23; Y10S 292/65
See application file for complete search history.

(56) References Cited

U.S. PATENT DOCUMENTS

| | | | | |
|---|---|---|---|---|
| 7,126,453 | B2 * | 10/2006 | Sandau | E05B 81/78 340/5.61 |
| 7,458,044 | B2 * | 11/2008 | Ito | G06F 30/367 716/106 |
| 8,505,241 | B2 * | 8/2013 | Kusunoki | E05B 81/76 49/360 |
| 9,458,649 | B2 * | 10/2016 | Fujiwara | E05B 85/103 |
| 11,214,991 | B2 * | 1/2022 | Gabriel | E05B 85/10 |
| 2005/0057050 | A1 | 3/2005 | Saitoh | |
| 2013/0170241 | A1 * | 7/2013 | Lesueur | E05B 85/18 362/501 |
| 2014/0047877 | A1 * | 2/2014 | Bohm | E05B 85/18 70/275 |
| 2017/0292297 | A1 * | 10/2017 | Bartels | E05B 77/04 |

FOREIGN PATENT DOCUMENTS

| | | | | |
|---|---|---|---|---|
| DE | 19740523 | A1 * | 3/1999 | G07C 9/37 |
| DE | 10114214 | A1 * | 12/2001 | G07C 9/37 |
| DE | 10240828 | A1 | 3/2004 | |
| DE | 10300573 | A1 | 7/2004 | |
| DE | 102006027473 | A1 | 12/2007 | |
| DE | 102006060540 | A1 | 6/2008 | |
| DE | 102010056437 | A1 * | 6/2012 | E05B 77/06 |
| DE | 102013212083 | A1 | 1/2014 | |
| DE | 102013212198 | A1 | 1/2014 | |
| DE | 112013000504 | T5 | 10/2014 | |
| EP | 0916789 | A1 | 5/1999 | |
| EP | 2581529 | A1 | 4/2013 | |
| EP | 2592201 | A2 | 5/2013 | |
| FR | 2776603 | A1 * | 10/1999 | G07C 9/00309 |
| GB | 2361675 | A * | 10/2001 | E05B 77/04 |
| JP | 09250265 | A * | 9/1997 | G07C 9/00309 |
| JP | 2005126912 | A | 5/2005 | |

OTHER PUBLICATIONS

Computer Generated Translation for DE 102006027473 A1, Generated on Jan. 13, 2022, https://worldwide.espacenet.com/ (Year: 2022).*
Computer Generated Translation for JP 2005126912 A, Generated on May 1, 2023, https://worldwide.espacenet.com/ (Year: 2023).*
Translation of International Search Report issued Jun. 18, 2019 for PCT/DE2019/100242.

* cited by examiner

DOOR HANDLE MODULE

FIELD OF INVENTION

The invention relates to a door handle module according to the preamble of independent claim 1 and a motor vehicle latching system according to the independent system claim.

BACKGROUND OF INVENTION

Door handles and door handle modules for electrically operable latches allow for the latch to be operated by means of sensors which are arranged on the vehicle or on the door handle, the sensors identifying an access intention of the user and, following authentication, releasing the latch. A disadvantage, however, is the fact that there is no mechanical redundancy. A door handle module of the type in question is known from DE 103 00 573 A1, an opening intention of the user being identified by means of a sensor unit. In an emergency or in the case of a vehicle that is switched to the currentless state it is, however, no longer possible to operate the latch mechanically by means of the door handle.

SUMMARY OF INVENTION

The object of the invention is that of overcoming the disadvantages known from the prior art, at least in part. In particular, the object of the invention is that of providing mechanical redundancy for operation of a motor vehicle latch.

The above object is achieved by a door handle module and by a motor vehicle latching system according to the disclosure. Advantageous developments and improvements of the invention are specified in the disclosure. It is noted that the exemplary embodiments described in the following are not limiting; instead, numerous combination and variation options for implementing the invention emerge from the features described in the description.

In this case, features and details that are described in connection with the door handle module according to the invention of course also apply in connection with the motor vehicle latching system according to the invention, and vice versa, such that reciprocal reference always is or can be made with respect to the disclosure of the individual aspects of the invention.

In practice, a distinction is made for example between side door latches, tailgate latches and bonnet latches or engine cover latches. In the course of the invention, these all come under the umbrella term "latch."

According to the invention, the door handle module for a movable part of a vehicle, in particular for a side door, tailgate, engine cover or luggage area flap, comprises a handle support that can be mounted on the shell of the movable part, a handle that is movably mounted on the handle support and has an operating mechanism that can be covered, at least in portions, by the shell, the operating mechanism being able to be operatively connected to a latch, in particular an electrical operable latch or a latch drive, such that in particular mechanical operation of the latch of the movable part can be performed. Furthermore, the door handle module comprises a sensor unit having at least one sensor element, in order to detect a user intention of a user in an operating region of a door handle cup of the movable part, as a result of which the latch or the latch drive can be electrically operated in the event of a detected user intention in the operating region.

As a result, the door handle module according to the invention comprises a mechanically operable handle by means of which mechanical operation of the latch or the latch drive is made possible. Furthermore, the door handle module comprises electrical and/or electromechanical operation, such that a sensor unit is provided in order to detect a user intention of a user in an operating region of a door handle cup. In this case, according to the invention the sensor unit can be arranged in the door handle cup and/or on the handle of the door handle module. It is thus conceivable, for example, for at least one sensor element of the sensor unit to be arranged in the region of the handle such that, when a user's hand engages in the door handle cup, the hand or at least a finger is already identified. It is furthermore conceivable for a sensor element to generate a corresponding sensor signal only by contact of a user's hand with the handle. It is likewise conceivable for a combination of sensor elements to be arranged on the door handle cup and on the handle. It is thus already possible for a movement sequence, for example engagement in the door handle cup, in particular in the operating region, and/or touching the handle, to lead to sensor signals. In this case, for example engagement of a user's hand in the operating region can trigger an authentication request using an ID transmitter carried by the user. If the user subsequently contacts the sensor element on a handle of the door handle module, it is thus possible for the latch by means of communication between the ID transmitter and the latch electronics or the vehicle electronics or control unit the latch to be released.

Within the context of the invention, an intention of a user can for example be an intention to open and/or an intention to lock or unlock the latch or the door. For this purpose, the sensor unit can be signal-connected to a control unit, for example of the latch or of the vehicle, in such a way that a sensor signal generated by the sensor unit is transmitted to the sensor unit. Thereupon, the control unit of the latch or of the vehicle can for example release an anti-theft device, such that the user can unlock the vehicle. For this purpose, the user can bring about electrical or electromechanical unlocking of the latch simply by operating the sensor unit, or can achieve mechanical opening by moving the handle.

In the present case, a latch or latch drive can also be understood as a control latch, as is used for example in sliding doors, or an electrically or electromechanically operable door opening/closing actuator which can be positioned independently of the latch.

Accordingly, the door handle module according to the invention is advantageous in particular for use in electrically operable latches. Accordingly, as a result of the mechanically operable handle, mechanical redundancy is provided which, in addition to electrical operation of the latch or of the latch drive, also allows for mechanical operation. It is thus possible, for example in the case of a current failure or a faulty door drive, for the door to nonetheless be unlocked or opened by mechanical operation of the handle.

It is furthermore conceivable for the handle to be designed as a rotatably mounted lever and can be pivoted by the user, by hand, in parallel with or orthogonally to the shell of the movable part. Accordingly, it is possible for a user to provide a conventional or known manner of operation for the movable part. In this case, the handle is movably mounted on the handle support of the door handle module, as a rotatably mounted lever. In particular, the handle is covered at least in portions, preferably completely, by the shell of the vehicle. The use can now mechanically operate the handle using his hand or at least a finger. For this purpose, the handle can be pivoted or moved in translation by a user, in parallel with or orthogonally to the shell of the movable part. Within the context of the invention, in parallel with the shell is intended to mean that the handle, in particular the rotatably mounted lever, is moved in the direction of the hinge pin or bearing pin of the movable part, or in the direction opposite to the bearing pin of the movable part and thus toward the latch. Within the context of the invention, orthogonal to the shell of the movable part is intended to mean that the user can pull the handle, in particular the lever, toward him, or can push it away from him, in the direction of the vehicle passenger compartment. In this case, orthogonal is also intended to include the possibility of the user being able to move the lever upward or downward, i.e. in the direction of the vehicle roof or vehicle floor.

It is furthermore conceivable for the handle to be able to be moved in translation by the user, i.e. moved away from the user, toward the vehicle passenger compartment, or toward the user. Accordingly, it is possible to push or pull the handle in parallel with the vehicle roof or vehicle floor.

This allows for mechanical redundancy for operating the latch in a conventional manner that is known to the user. Accordingly, the handle can be operated in an intuitive manner.

It is advantageously possible for the sensor unit to be a fingerprint sensor and/or a capacitive sensor and/or an inductive sensor and/or an optical sensor and/or a biometric sensor and/or an image acquisition unit. In this case, a fingerprint sensor allows for identification of the user by means of recognition of the individual fingerprint of the user. A capacitive sensor is cost-effective and can be used in particular for recognizing a movement of the user in the operating region. An optical sensor is also cost-effective and can be used for detection in the operating region and/or on the handle. A biometric sensor can also be used in particular for identifying a user. It is furthermore conceivable to provide an image acquisition unit, for example a camera, for recognizing a user intention. In this case, the image acquisition unit can be used both for authentication, for example recognition of a user's face, or for identification of a movement, in particular an opening intention of the user. A combination of identical or different sensors is also conceivable in this case. This allows for reliable identification, and thus a high degree of functional/operational reliability. It is in particular possible to thereby at least reduce error detection.

Within the context of the invention, the sensor unit, in particular the fingerprint sensor, can identify at least two different fingers and/or at least one gesture of a user. In this case, the fingerprint sensor is designed such that two different fingers of the user can be identified, in particular independently of one another. Incorrect operation of the fingerprint sensor by the user can be reduced thereby.

It is furthermore conceivable for the sensor unit to identify a gesture, for example by the user's hand or foot, in the region of the operating region. The user can thus provide a gesture, in particular using his hand and/or a finger and/or foot, in the region of the operating region, such that it is possible to achieve electrical operation following identification by the sensor unit. Using the sensor unit for identifying a fingerprint can be improved by different fingers being identified by the sensor, and thus a distinction being made between whether there is an opening intention or accidental operation. Furthermore, the sensor unit can be used for identifying whether someone is wearing gloves such that, for example, the sensor is designed such that it is possible to identify, on the basis of the surface structure, whether there is an opening intention or whether, for example in the case of a wash system or swirled fluid, dirt or dust on the sensor unit generates an opening signal. In order to be able to exclude misuse, i.e. incorrect operation, it is possible for redundancies to be provided in the case of the sensor unit, such that two different fingers or different sensor elements can be used.

The sensor unit is preferably arranged on and/or at the handle. It is thus possible, for example, for a fingerprint sensor to be arranged at or on the handle such that, in the case of intuitive operation by the user, i.e. grasping behind or placing a hand or a finger on the handle, this is identified. The fingerprint sensor makes it possible to identify whether one or more human fingers are in contact, at all, and whether there is an opening intention, such that incorrect activation of the sensor, for example by a wash system, can be prevented. A combination of different sensor elements or sensor units is conceivable according to the invention. As a result, further incorrect identifications or incorrect operation can at least be reduced.

It is conceivable, according to the invention, for a display element 60 (see FIG. 1) to be provided, the display element being able to illuminate the handle cup and/or the shell, at least in portions. The display element can for example be an LED unit or an OLED unit which is connected to the control unit of the latch or the vehicle control unit such that the handle up and/or part of the shell can be illuminated, at least in portions. The display unit can for example be used as a status display, as a notification for the user or for simple lighting or illumination of the operating region. It is for example conceivable for the display unit to display, in the region of the operating region or on the shell of the vehicle, the status of the latch (for example locked or unlocked, or secured or unsecured). It is furthermore conceivable for the display element to illuminate notifications for the user, such that the user identifies how or where the operating region of the handle or of the door handle module is arranged. It is furthermore conceivable for the display unit to illuminate at least the operating region or for example an approach region of the movable part.

It is conceivable for the information regarding the status of the door/the door system to be given to the user optically, acoustically or haptically. This may for example be displaying the locking status of the door, connectivity statuses, preselected door speeds, opening angles or virtual door locks. Movements soon to start, of an actuated door, can also be displayed. This also includes displaying the pivot radius, e.g. by means of projection on the ground. Furthermore, the user can be notified of the authentication status, e.g. in the event of successful or unsuccessful authentication, by means of a biometric sensor for example.

It is advantageously possible for the operating mechanism to comprise at least one lever mechanism and/or a Bowden cable, as a result of which a mechanical operative connection between the handle and the latch can be established. In this case, the lever mechanism can preferably connect the handle to a latch mechanism such that, following operation of the handle by the user, the force can be transferred to the latch mechanism. It is particularly advantageous for a Bowden cable to be arranged between the handle and the latch, for actuation, such that the mechanical force from the operated handle can be transferred to the latch. In this case, the Bowden cable allows for a flexible arrangement and/or flexible laying of the transfer means between the latch mechanism and the handle. Furthermore, a Bowden cable is cost-effective to manufacture and allows for simple mounting.

Within the context of the invention, a power connection can be provided, as a result of which the latch or the latch drive can be supplied with electrical power from outside the vehicle. In this case, the power connection can be hidden, for example behind a cover, in the operating region. It may thus be advantageous, for example, for the cover to be removed only by a further operation by the user, for example removing the cover using a lever tool or a mechanical door key, and thus releasing the power connection. It is conceivable, for example, to connect an energy storage device via the power connection, such that in particular a latch drive is electrically operable. This can be advantageous in particular if the vehicle is switched to the currentless state.

It is furthermore conceivable for mechanical emergency operation to be provided, for example by means of a cable, the cable being connected for example to the operating mechanism or the latch mechanism, and the mechanical cable being able to be led out of the door handle module.

Within the context of the invention, the handle can be pivotable about a pin, such that the handle is moved into the original position thereof following mechanical operation by a user. In this case, the pin can be designed such that the handle is arranged in parallel with or orthogonal to the shell of the movable part. Accordingly, the handle, in particular the lever, can be pivotable, and thus rotatably movable, along the pin. In this case, the pin can for example comprise a spring, in particular a torsion or preferably double torsion spring, such that the handle, in particular the lever, is spring-mounted. As a result, following operation of the handle said handle is moved back into the original position thereof owing to the spring force. Furthermore, the spring allows for tactile feedback of the operation of the handle by the user. This allows for tactile operation, as is known to the user from conventional door handle systems.

It is furthermore conceivable for a receptacle for a locking cylinder to be arranged on the handle support, the locking cylinder being able to be arranged in the receptacle such that the locking cylinder is concealed by the shell and/or the handle, at least in portions. The receptacle is advantageously also concealed by the shell or the handle. This allows for an optically appealing outside appearance of the door handle module, and thus of the movable part. A conventional locking cylinder can therefore be arranged on the door handle module, such that, in the case of a currentless vehicle, the latch can be unlocked or locked, and/or opened, by means of the locking cylinder and a mechanical key. In this case, according to the invention, the locking cylinder is arranged in the receptacle in such a way that it can be concealed by the shell and/or by the handle. It is conceivable, for example, for the locking cylinder, and thus the receptacle for the locking cylinder, to be arranged behind the handle, such that the locking cylinder is released only by operation of the handle, for example by the handle being pulled toward the user. Accordingly, the locking cylinder is protected against outside environmental influences, and at the same time the outside appearance can be improved thereby.

The handle is advantageously bidirectionally operable and connected to a bidirectionally acting operating mechanism. Accordingly, the handle can be moved in a first operating direction x and a second y which opposes the first operating direction. It is thus possible for opening of a latch to be achieved in a first operating direction x, and for closure of a latch to be achieved in a second opposing operating direction y. The first operating direction is directed orthogonally away from the vehicle shell, and the second opposing operating direction y is directed toward the vehicle shell, such that, as a result of an accident and an associated unintended action of force, for example by deformation of the shell, on the handle, the handle is operated in the closing direction. This makes it possible to prevent the latch of a movable part from being able to be opened or unlocked.

It may preferably be possible for the handle to be able to be fixed. As a result, the handle can be mechanically fixed in a position. It is conceivable, for example, for an operating mechanism, in particular a lever mechanism or a Bowden cable, to be fixed in such a way that the handle is thereby fixed in a position. Pivoting about the hinge/pivot pin is then no longer possible, and the haptics of the door handle module can be changed or the crash safety can be increased. For this purpose, the lever mechanism can be blocked, or a Bowden cable can be pre-loaded, as a result of which the handle can be fixed in a desired position. It is furthermore conceivable for the handle to be fixed in a position by means of an actuator. Accordingly, a rigid handle can be achieved.

According to a further aspect of the invention, a motor vehicle latching system comprising at least one door handle module according to the invention and a latch and/or a latch drive for electromechanical operation of the latch is claimed. As a result, a motor vehicle latching system according to the invention is associated with the same advantages as have been described in detail with reference to the door handle module according to the invention.

In the following, the invention will be explained in greater detail with reference to the embodiment shown schematically in the drawings. However, it is not restricted thereto, but rather covers all the embodiments defined by the claim. In this case, functionally identical elements are provided in the figures with identical reference signs. The above-mentioned features and advantages, as well as other features and advantages of the present invention, are readily clear from the following detailed description of the preferred embodiments and best embodiment types of the invention, when considered in connection with the accompanying drawings.

DETAILED DESCRIPTION

Figure 1:
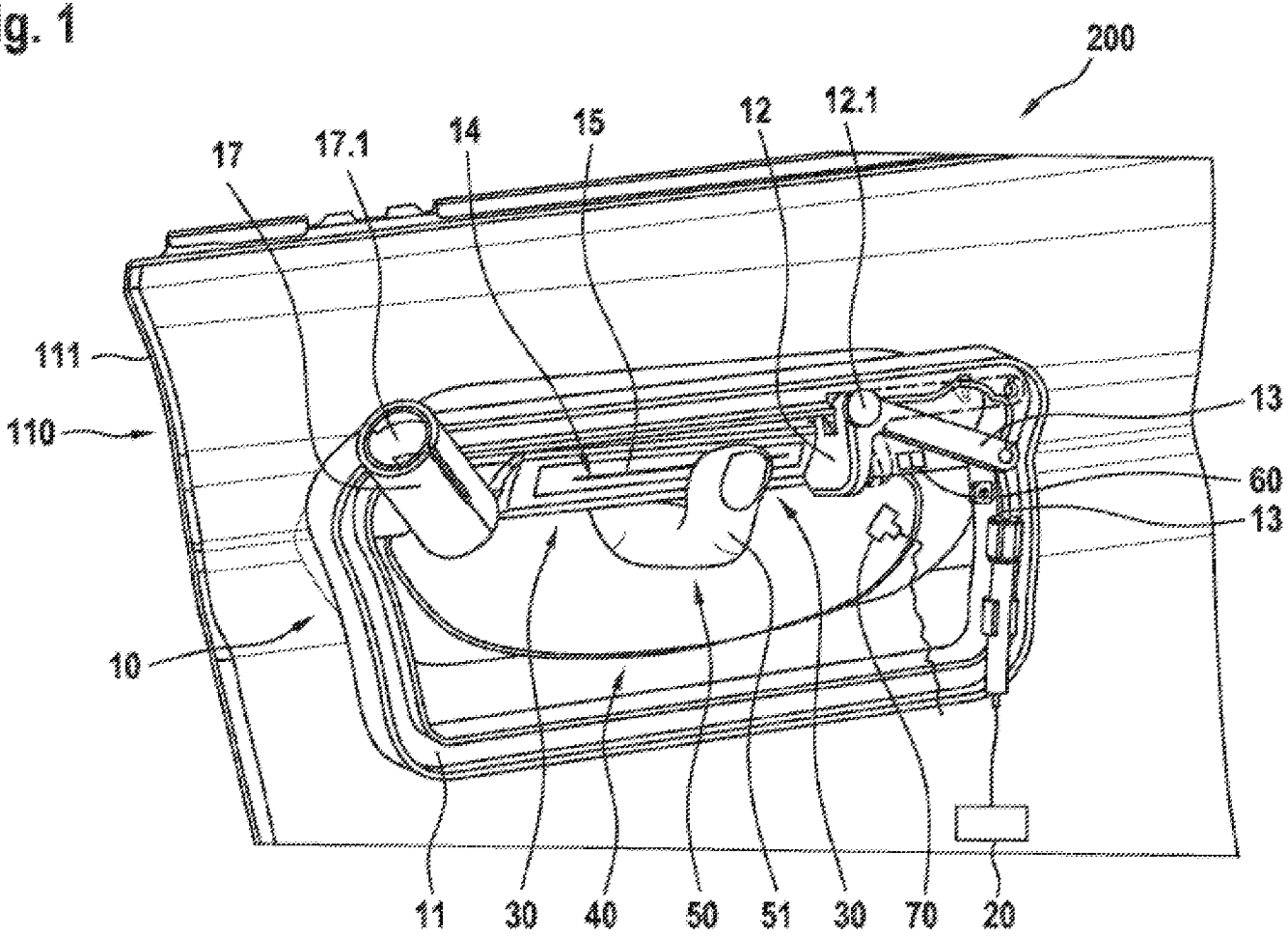
FIG. 1 shows a first possible embodiment of a motor vehicle latching system according to the invention comprising a first possible embodiment of a door handle module according to the invention.

FIG. 1 describes a motor vehicle latching system according to the invention comprising a door handle module according to the invention, in a first embodiment. In this case, the door handle module 10 is mounted on a movable part 110. The movable part 110 comprises a shell 111, the handle support 11 of the door handle module 10 being mounted on the shell 111 of the movable part 110. In this case, the handle support 11 is arranged around a door handle cup 40 on the shell 111 of the movable part 110. The door handle cup 40 thus makes it possible for a hand 50 or a finger 51 of a user to engage in the door handle cup, and for the handle 12 to be controlled by a finger 51 of a user. For this purpose, the handle 12 comprises a hinge pin 12.1, the handle 12 being able to be pivoted, in FIG. 1, by the finger 51, in parallel with the shell 111. In FIG. 1, this means that the handle 12 is designed as a lever and can be pivoted to the right or to the left, about the hinge pin 12.1, in the plan view in FIG. 1. The handle 12 is connected to an operating mechanism 13, the operating mechanism consisting of a lever arm and a Bowden cable. By means of operation, i.e. pivoting, of the lever 12, a lever arm 13 is now operated such that a Bowden cable 13 is moved by the lever arm 13. In this case, the Bowden cable 13 is connected to the latch 20, such that mechanical operation of the latch by the user is possible. The handle, in this case the lever 12, is concealed by the shell 111 at least in portions.

Furthermore, FIG. 1 shows a receptacle 17 for a locking cylinder 17.1 on the handle support 11 of the door handle module. In this case, the locking cylinder 17 and the locking cylinder receptacle 17.1 are arranged in the door handle cup 40 such that this is concealed, at least in portions, by the shell 111 of the movable part 110. In the case of normal operation of the door handle module, i.e. when a user approaches the movable part, for example a door, the locking cylinder 17.1 cannot be identified.

Furthermore, FIG. 1 shows a sensor unit 14 on the door handle module 10, comprising a sensor element 15. In FIG. 1, the sensor unit 14 is provided with an elongate sensor element 15, such that engagement therein or a touch by a finger 51 of a user can be identified. Furthermore, FIG. 1 shows a power connection 70 which faces out of the door handle cup 40.

The movable part is shown as a side door or passenger door, but, within the spirit and scope of the present invention, any vehicle door, including swing doors or tailgates, engine covers, side sliding doors, tail lifts, or the like, can be envisaged.

Figure 2:
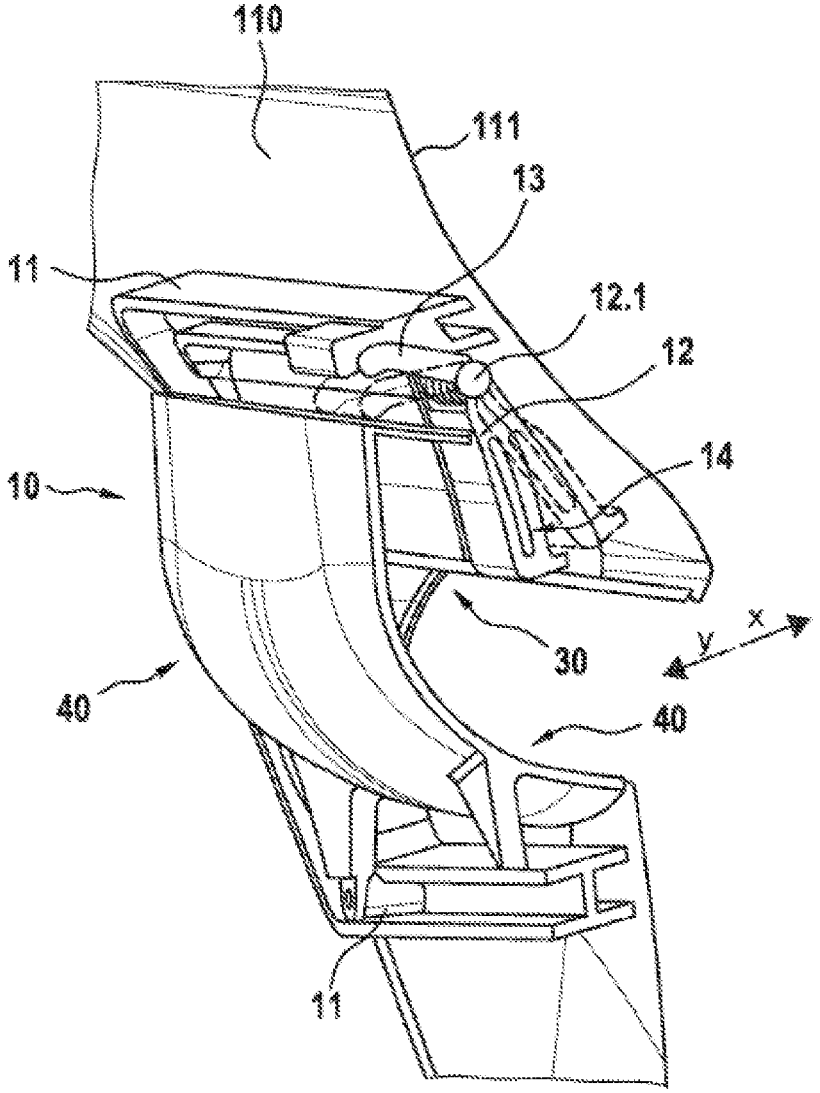
FIG. 2 shows a further possible embodiment of a door handle module according to the invention.

FIG. 2 shows a further embodiment of a door handle module according to the invention. In this case, the door handle module 10 is arranged on a shell 111 of a movable part 110, having a toward the handle support 11. In FIGS. 1 and 2, the movable part 110 is shown schematically as a door of a motor vehicle. A door handle cup 40 is arranged on the movable part 110, which cup is formed as a concave recess in the movable part 110. This makes it possible for a user to insert a hand into the door handle cup 40. The hand can then be moved in the operating region 30, as a result of which electrical/electronic and/or electromechanical or purely mechanical operation can take place. For this purpose, the door handle module 10 comprises a handle 12 which is arranged so as to be movable about a hinge pin 12.1.

In FIG. 2, the handle 12 is rotatable about the hinge pin 12.1 such that the user can move the handle 12 toward or away from him, and thus pivot it about the hinge pin 12. Furthermore, the handle is substantially entirely concealed by the shell 111. This means that the user can simply grasp inside the door handle cup 40 from below, in order to operate the handle. Therefore, the handle is substantially, i.e. in normal use, not visible from the outside of the vehicle. As a result, an optically improved appearance of the vehicle, in particular of the shell, is made possible.

For electronic or electromechanical operation, the handle 12 comprises a sensor unit 14 which is arranged in the handle 12. As a result, a user intention can be identified by the sensor unit 14 being approached or the handle 12 being touched. Furthermore, mechanical pivoting of the handle 12 about the pin 12.1 can achieve purely mechanical operation. For this purpose, an operating mechanism 13 in the form of a lever is arranged on the handle 12. In this case, the lever can be mechanically connected to the latch for example by means of a Bowden cable or a further lever.

The handle 12 is bidirectionally operable and is connected to a bidirectionally acting operating mechanism 13. Accordingly, the handle 12 can be moved in a first operating direction x and a second y which opposes the first operating direction. It is thus possible for opening of a latch to be achieved in a first operating direction x, and for closure of a latch to be achieved in a second opposing operating direction y. The first operating direction x is directed orthogonally away from the vehicle shell 111, and the second opposing operating direction y is directed toward the vehicle shell 111, such that, as a result of an accident and an associated unintended action of force, for example by deformation of the shell, on the handle 12, the handle 12 is operated in the closing direction. This makes it possible to prevent the latch of a movable part from being able to be opened or unlocked.

Figure 3:
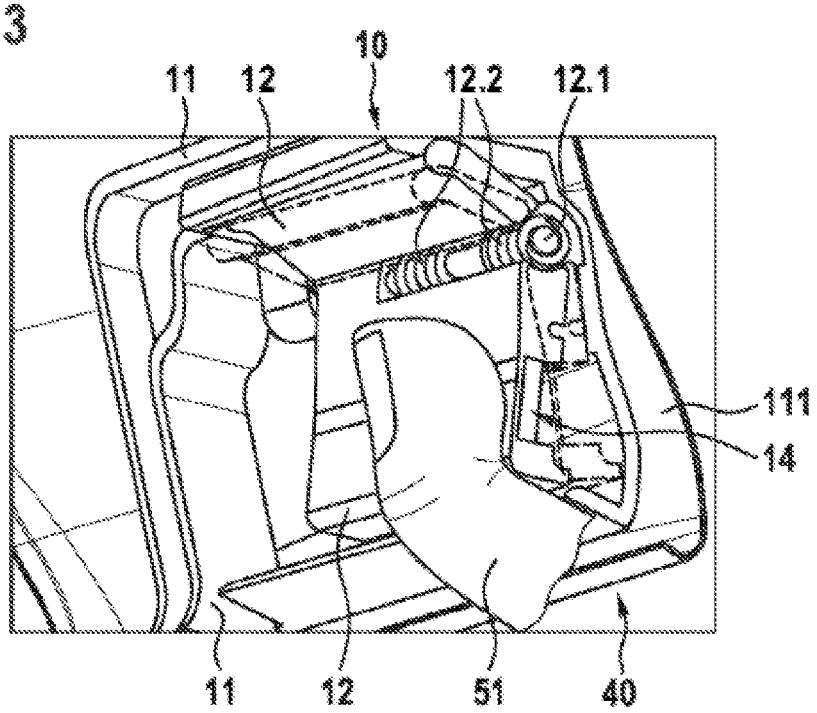
FIG. 3 shows a further possible embodiment of a door handle module according to the invention.

FIG. 3 shows a further embodiment of a door handle module 10 according to the invention. In this case, too, the door handle module 10 is mounted on a shell 111 of a movable part. In this case, the handle 12 is mounted so as to be rotatable or pivotable about a pin 12.1. It is thus possible for a user to pivot the handle 12 about the pin 12.1 by means of a finger 51, for example by pulling or pushing. Furthermore, at least one spring 12.2, in particular a double torsion spring 12.2, is arranged on the pin 12.1 of the handle 12. This allows for automatic, i.e. independent, movement of the handle 12 into the original position thereof. A sensor unit 14 is arranged on the handle 12, such that it is possible to detect, by sensor means, a finger 51 approaching or touching the handle 12.

In FIG. 3, too, the handle is substantially entirely concealed by the shell 111. This means that the user can simply grasp inside the door handle cup 40 from below, in order to operate the handle 12. Therefore, the handle 12 is substantially, i.e. in normal use, not visible from the outside of the vehicle. As a result, an optically improved appearance of the vehicle, in particular of the shell 111, is made possible.

Figure 4:
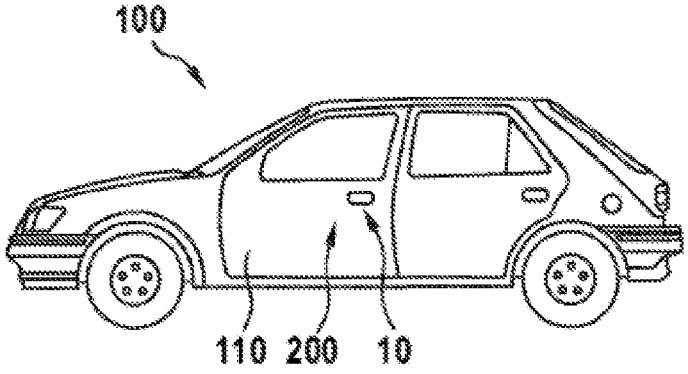
FIG. 4 shows a motor vehicle comprising a motor vehicle latching system according to the invention.

FIG. 4 shows a vehicle 100 comprising a movable part 110 and a motor vehicle latching system 200 and a door handle module 10 according to the invention.

The above explanation of the embodiments describes the present invention exclusively within the context of examples. Of course, individual features of the embodiments can, if technically expedient, be freely combined with one another, without departing from the scope of the present invention.

LIST OF REFERENCE SIGNS

10 door handle module
11 handle support
12 handle
12.1 hinge pin of the handle
12.2 spring
13 operating mechanism
14 sensor unit
15 sensor element
16 control unit
17 receptacle for locking cylinder 17.1
17.1 locking cylinder
20 latch
30 operating region
40 door handle cup
50 hand
51 finger

60 display element
70 power connection
100 vehicle
110 movable part
111 shell of the movable part 110
x first operating direction
y second operating direction

The invention claimed is:

1. A door handle module for a movable part of a vehicle, the door handle module comprising:

a door handle cup mounted on a shell of the movable part, wherein the door handle cup defines an indentation with respect to the shell of the movable part, wherein a handle of the door handle module covers a first portion of the indentation and a second portion of the indentation is always left exposed to permit a user to engage in the door handle cup to operate the handle, wherein a portion of the shell covers the first portion of the indentation such that the handle is concealed between the portion of the shell and the door handle cup, wherein the handle is movably mounted on a handle support and has an operating mechanism that is covered, at least in portions, by the shell, wherein the handle is movable relative to the portion of the shell while the portion of the shell is stationary and the handle is arranged on the handle support such that movement of the handle is entirely concealed by the shell, wherein the handle support is mounted on the shell of the movable part, wherein the handle support is arranged around the door handle cup on the shell of the movable part, an electrically operable latch, wherein the operating mechanism is operatively connected to the latch for mechanical operation of the latch, and a sensor unit having at least one sensor element to detect a user intention of a user in an operating region of the door handle cup, wherein the latch is electrically operated in response to a detected user intention in the operating region.

2. The door handle module according to claim 1, wherein the handle is formed as a rotatably mounted lever and is pivoted by the user, by hand, in parallel with or orthogonally to the shell of the movable part.

3. The door handle module according to claim 1, wherein the sensor unit includes a fingerprint sensor and/or a capacitive sensor and/or an optical sensor and/or a biometric sensor and/or an image acquisition unit.

4. The door handle module according to claim 3, wherein the sensor unit includes the fingerprint sensor and can identify at least two different fingers and/or at least one gesture of the user.

5. The door handle module according to claim 1 further comprising a display element configured to illuminate the door handle cup and/or the shell, at least in portions.

6. The door handle module according to claim 1, wherein the operating mechanism comprises at least one lever mechanism and/or a Bowden cable for forming a mechanical operative connection between the handle and the latch.

7. The door handle module according to claim 1 further comprising a power connection for supplying the latch with electrical power from outside the vehicle.

8. The door handle module according to claim 7, wherein the power connection faces out of the door handle cup.

9. The door handle module according to claim 1, wherein the handle is pivotably spring-mounted about a pin, wherein the handle is moved automatically back into an original position following a mechanical operation of the handle by the user.

10. The door handle module according to claim 1 further comprising a receptacle for a locking cylinder arranged on the handle support, the locking cylinder being arranged in the receptacle such that at least the locking cylinder is concealed by the shell and/or the handle, at least in portions.

11. The door handle module according to claim 10, wherein the locking cylinder and the receptacle are arranged in the door handle cup.

12. The door handle module according to claim 1, wherein the handle comprises a bidirectionally acting operating mechanism, wherein opening of the latch is achieved in a first operating direction, and closure of the latch is achieved in a second opposing operating direction.

13. The door handle module according to claim 12, wherein the first operating direction is directed orthogonally away from the shell, and the second opposing operating direction is directed toward the shell, wherein, during an accident and an associated unintended action of force on the handle, the handle is operated in the second opposing operating direction.

14. A motor vehicle latching system comprising at least one door handle module according to claim 1 and the electrically operable latch.

15. The door handle module according to claim 1, wherein the movable part is a side door, tailgate, engine cover, or luggage area flap.

16. The door handle module according to claim 1, wherein the at least one sensor element is elongated.

17. The door handle module according to claim 1, wherein the handle comprises a hinge pin and the handle is pivoted about the hinge pin.

* * * * *